United States Patent [19]

Ebeling

[11] 4,427,333

[45] Jan. 24, 1984

[54] LOADER FOR A VEHICLE BODY

[76] Inventor: Franklin D. Ebeling, P.O. Box 1925, Plainview, Tex. 79072

[21] Appl. No.: 296,007

[22] Filed: Aug. 25, 1981

Related U.S. Application Data

[63] Continuation-in-part of Ser. No. 239,581, Mar. 2, 1981, abandoned.

[51] Int. Cl.[3] ..... B65F 3/08

[52] U.S. Cl. ..... 414/409; 414/422

[58] Field of Search ..... 414/406, 408, 409, 422, 414/595, 598, 599, 617, 628, 629, 648, 449

[56] References Cited

U.S. PATENT DOCUMENTS 3,844,434 10/1974 Blakely et al. ..... 414/409

3,910,434 10/1975 Ebeling et al. ..... 414/408

*Primary Examiner*—Robert G. Sheridan

*Attorney, Agent, or Firm*—Cushman, Darby & Cushman

[57] ABSTRACT

A vehicle having a body for receiving trash or other material from a container is fitted with a loading arrangement which lifts the container from the ground, raises the container and tips it to dump the contents into the vehicle body. The loading arrangement includes an upright mast assembly attached to the vehicle, a container engaging device mounted on the mast assembly for guided movement therealong and a drive mechanism for raising and lowering the engaging device, the drive mechanism including an articulated linkage having a lower end pivotally connected to the engaging device for movement about a horizontal axis. The upper end of the linkage is mounted for swinging movement about a second horizontal axis. A power device is connected to the upper end portion of the linkage to swing the latter in a vertical plane transverse to the vehicle axis. Upward swinging movement raises the container engaging device along the mast assembly to the upper end of its path of travel and then tips the container in a tipping mode.

7 Claims, 7 Drawing Figures

LOADER FOR A VEHICLE BODY

This is a continuation-in-part of application Ser. No. 239,581 filed Mar. 2, 1981, now abandoned.

This invention relates to loading apparatus, adapted to be carried by a vehicle, for engaging a container of trash, garbage or other material, raising the container to a dumping position, tipping the container to dump its contents into the vehicle body and returning the container to a desired level where it is released from the apparatus.

BACKGROUND OF THE INVENTION

The present invention represents an improvement in the drive portion of the type of loading equipment described in U.S. Pat. No. 3,910,434, the subject matter of which is incorporated herein by reference.

The loading equipment disclosed in the above-identified patent includes an upright mast assembly which is carried on one side of the vehicle and a container engaging device mounted on the mast assembly for guided vertical movement therealong. The drive system for raising and lowering the container engaging device includes an endless chain and sprocket arrangement powered by a hydraulic rotary motor. More specifically, the mast assembly comprises two upright channel members which are spaced apart along the axis of the vehicle and which face toward each other so as to provide two tracks for guiding the container engaging device. The latter extends between the two channel members and is fitted with rollers which engage the tracks. The chain and sprocket arrangement includes two spaced-apart chains which together with the sprockets are mounted between the channel members, and the engaging device is attached to the chains. The upper ends of the tracks are curved toward the vehicle body so that after the engaging device and the container carried thereby reach their maximum elevation continued movement of the chains over the upper sprocket causes the engaging device and the container to tip toward the vehicle body.

SUMMARY OF THE INVENTION

It has been found in practice that the chains and sprockets in the above-summarized drive system, while performing satisfactorily, tend to be subject to considerable wear and consequent repair and/or replacement costs. In addition, when the chains rotate over the upper sprockets so as to tip or swing the container, the longer path followed by the container results in an increase in the speed of the container. Some of the resulting centrifugal forces on the container are transmitted through the engaging device to the chains and sprockets, creating additional problems of wear. Further wear problems and problems of impact damage can arise from the inertial forces which are created when the chains are brought to a stop at the end of the tipping operation.

The present invention provides an improved raising and lowering mechanism which replaces the chain and sprocket system summarized above. The new mechanism does not employ sprockets or chains and is thus free of the problems of wear and breakage associated with those elements. Rather, the new mechanism employs an articulated arm arrangement which is relatively free of wear and breakage problems. In the preferred embodiment the articulated arm arrangement is powered by a hydraulic cylinder and piston connected to swing the upper arm by means of a special linkage which operates in conjunction with the articulated arm assembly and the guide tracks to tip or swing the engaging device and the container along a path and at a rate such that centrifugal and inertial forces do not create any substantial wear and impact problems. It is self-evident that if the container engaging device is moved along the arcuate upper end portions of the channel members at a constant speed, then the container which extends outwardly from the engaging device will increase in speed as the path of travel changes from linear to arcuate. The arm and linkage arrangement of the present invention coact to automatically reduce the speed of the engaging device in the radius portion of its travel, compared to the speed when moving along a more linear path. More specifically, the speed of the attachment gradually increases as it is raised along the straight portions of the channel members. The engaging device then gradually slows down along the radius portion of the tracks until it moves past the swing axis of the upper end of the articulated arm assembly. A substantially constant speed is attained until the linkage reaches its maximum travel, causing the engaging device to stop and complete the dumping of the container contents. A supplemental stop means may be provided if desired.

DETAILED DESCRIPTION

Figure 1:
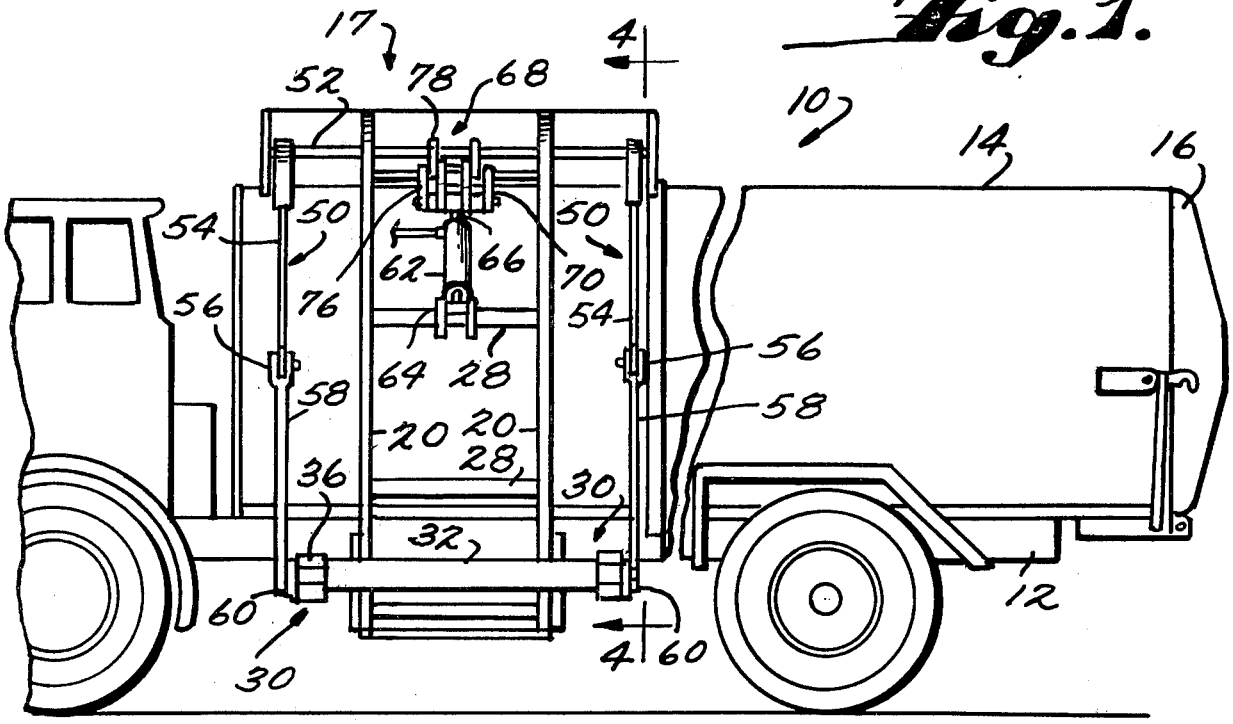
FIG. 1 is a fragmentary schematic elevational view of a vehicle to the side of which the loading assembly of the present invention has been attached.
Figure 2:
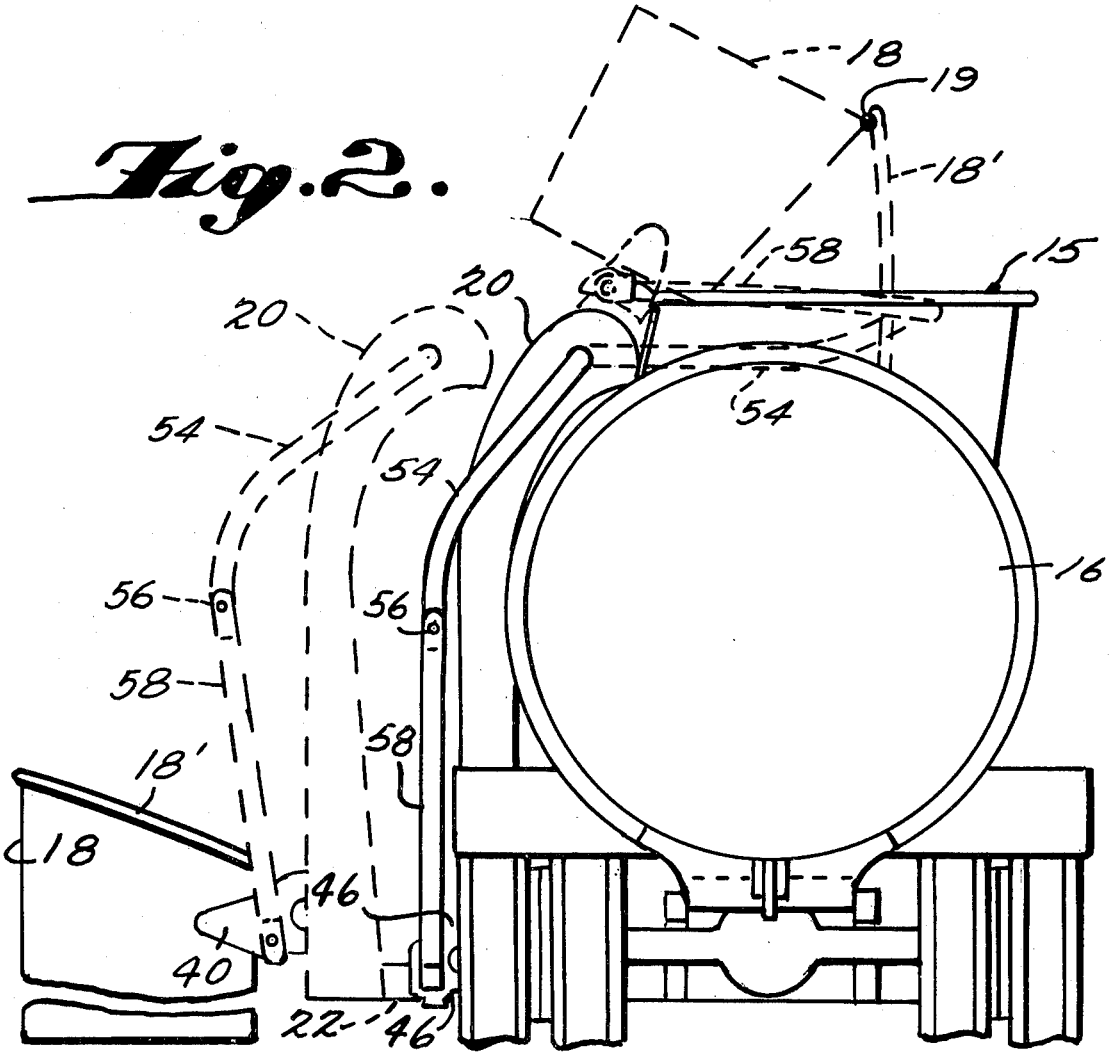
FIG. 2 is a schematic rear view of the vehicle of FIG. 1.
Figure 4:
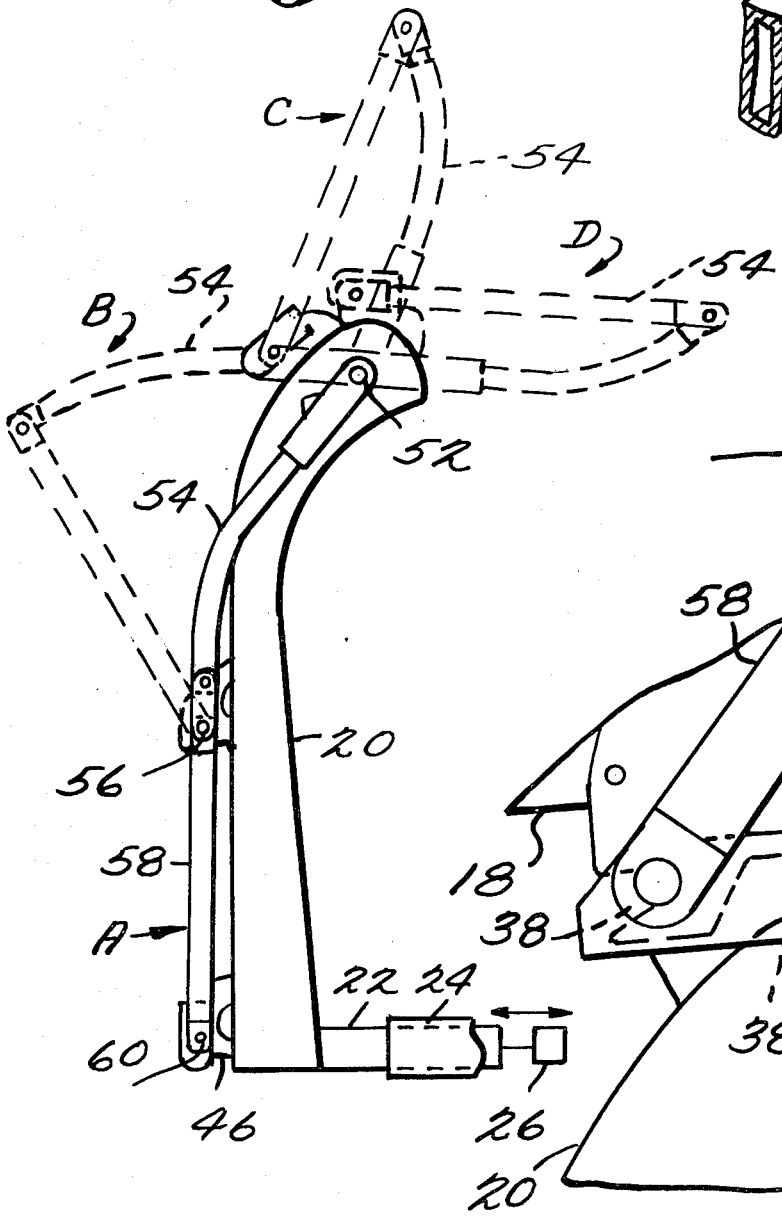
FIG. 4 is a fragmentary view of the raising and lowering mechanism taken generally on the line 4—4 of FIG. 1.

FIGS. 1 and 2 illustrate a vehicle 10 having a frame 12 on which a body 14 is mounted. The body 14 has a top opening 15 near the front end thereof for receiving trash, garbage or the like and an end gate 16 for removal of the body contents. Carried by one side of the vehicle, the left side in the illustrated embodiment, is a loader 17 for handling a container 18, more specifically for engaging, raising, dumping and returning the container 18 to a desired elevation. The container includes a lid 18' hinged for swinging movement about an axis 19. The loader includes an upright mast assembly which includes two spaced-apart channel members 20 each rigidly connected at its lower end to a horizontal frame member 22 which extends transversely of the vehicle 10. The frame members 22 are telescopically received into fixed tubular support members 24 (see FIG. 4) which are carried by the vehicle frame 12, as by means of mounting plates or the like (not shown) welded to both the support members 24 and to the frame 12. The frame members 22 are longitudinally movable in the tubular support members 24 by means of a drive mechanism illustrated schematically at 26 (FIG. 4). The two upright channel members 20, which are rigidly interconnected by horizontal members 28, can therefore be moved transversely of the vehicle 10 during a container-handling operation. The limit positions of the channel members 20 are shown in FIG. 2. Alternatively, the mast assembly, i.e. the two interconnected channel members 20, can be mounted at or near its upper end for limited swinging movement in a vertical plane which is transverse to the axis of the vehicle 10; the important function to be attained is that of bringing the lower end of the mast assembly into engagement with the stationary container 18, as illustrated in FIG. 2.

Figure 3:
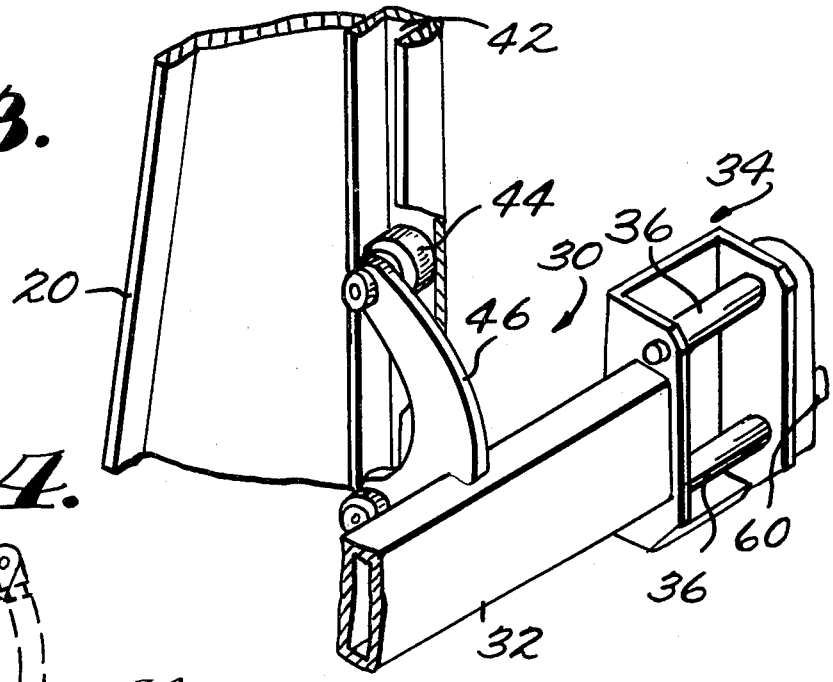
FIG. 3 is a fragmentary perspective view of the lower end portion of the raising and lowering mechanism for the container.
Figure 6:
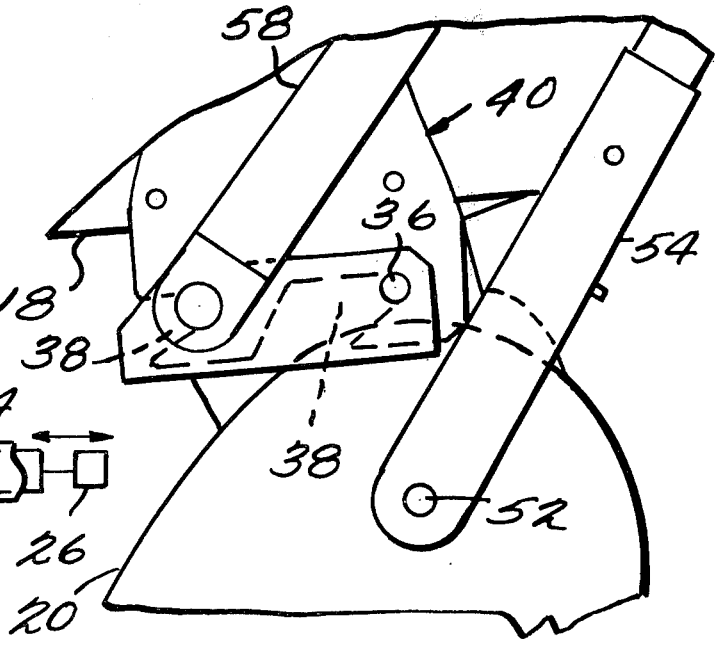
FIG. 6 is a fragmentary view illustrating the upper end portion of the raising and lowering mechanism at the beginning of a container-tipping operation.

A container engaging or pick-up device 30 is located between the two channel members 20 of the mast assembly and is arranged for guided vertical movement relative to the channel members 20. The engaging device 30 is adapted to engage and interlock with complementary fittings on the container 18 in any convenient way. The details of the engaging device 30 therefore are not critical. As shown in FIGS. 1 and 3 the device 30 includes a rigid horizontal support member 32 which carries two spaced-apart engaging fittings 34. Each fitting 34 includes two vertically spaced-apart horizontal rollers 36 disposed parallel to the vehicle axis. The rollers 36 are adapted to engage in downwardly-open, hook-shaped slots 38 formed in brackets 40 (FIGS. 2 and 6) which are rigidly secured to the ends of the container 18. A lock assembly, for example as described in the aforesaid U.S. Pat. No. 3,910,434, is provided for locking the rollers 36 in the slots 38 during a container-handling operation.

The container engaging device 30 is mounted for movement along the length of the mast assembly by means of a roller connection to each of the channel members 20. As shown in FIG. 3 the channel member 20 (which is the right-hand channel member seen in FIG. 1) provides a slot or runway 42 which receives a pair of rollers 44 carried by a bracket 46 welded to the member 32 of the engaging device 30. The other channel member 20 is a mirror image of the illustrated channel member and similarly cooperates with another set of rollers carried by the member 32.

The upper end portions of the channel members 20 and the runways 42 curve toward the body 14 of the vehicle 10 to aid in guiding the container engaging device 30, and hence any container 18 carried thereby, into a tipping or dumping mode as the device 30 is raised along the runways 42. FIG. 2 illustrates the container 18 in its initial position on the ground and in phantom line in its final tipped position.

All of the above is more fully described in the aforementioned U.S. Pat. No. 3,910,434 and further description here is unnecessary. The present invention is concerned with an improved drive arrangement for the container engaging device 30, this drive arrangement being illustrated in FIGS. 4, 5*a*, 5*b* and 6 and to a lesser extent in FIGS. 1 and 2.

The new drive arrangement includes a pair of identical articulated arm assemblies 50 connected between the container engaging device 30 and a rotatable horizontal shaft 52 located between and journalled near each end in the two channel members 20. Each assembly 50 includes an upper arm 54 rigidly secured at its upper end to the rotatable shaft 52. The lower end of each arm 54 is pivotally attached at 56 to the upper end of a lower arm 58 for rotation about a horizontal axis which is parallel to the axis of the shaft 52. The lower end of each lower arm 58 is pivotally attached at 60 to one end of the container engaging device 30 for rotation about an axis parallel to the axis of the shaft 52. When the shaft 52 is caused to rotate clockwise as viewed in FIG. 4, by a drive device such as that described below, the articulated arm assemblies 50 swing in vertical planes which are transverse to the axis of the vehicle, and in so doing they raise the engaging device along the channel members 20. FIG. 4 shows the sequential positions A, B, C and D of the arms 54 and 58 during the raising operation, and FIG. 2 shows the position of the container on the ground and when the arm assemblies 50 have reached their limit positions.

A preferred drive device for rotating the shaft 52 includes a generally upright hydraulic piston and cylinder unit inclined slightly toward the vehicle body 10 and connected between the mast assembly and the shaft 52. The cylinder 62 of the unit is connected at its lower end at 64 to one of the reinforcing members 28 for pivotal movement about an axis parallel to the axis of the shaft 52. The piston rod 66 of the unit is connected to the shaft 52 by means of a linkage 68 which is shown schematically in FIG. 1 and in detail in FIGS. 5*a* and 5*b*. It will be seen that the path of travel of the piston rod 66 is offset from the axis of the shaft 52.

Figure 5B:
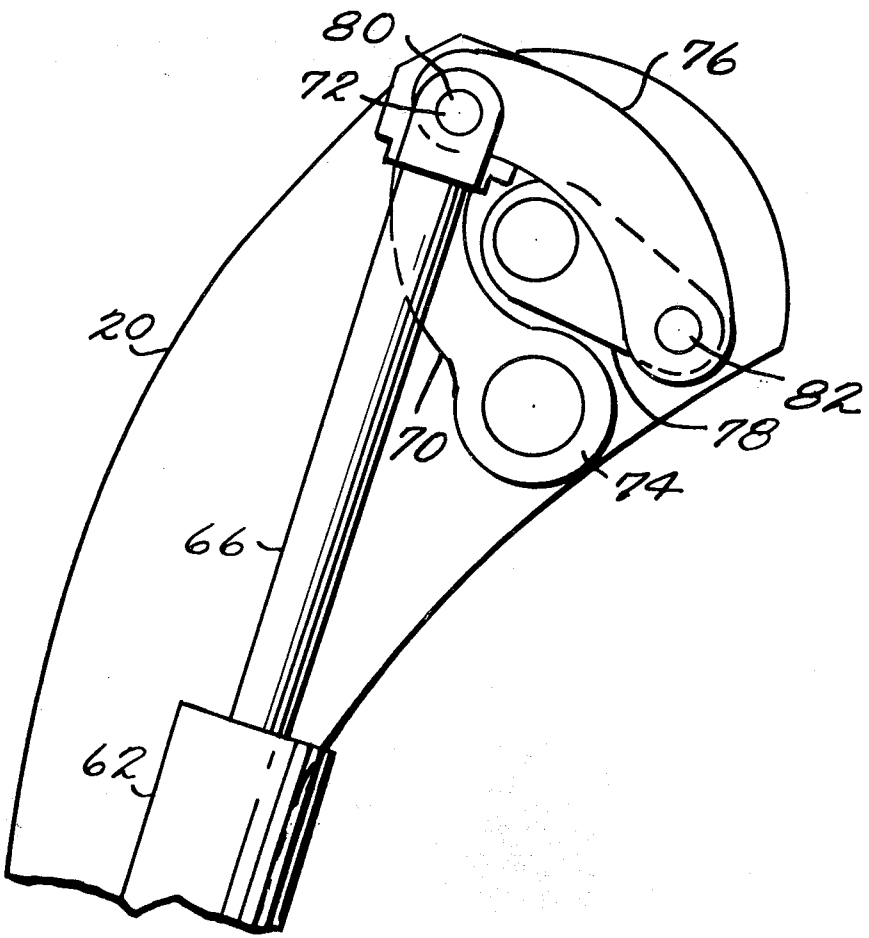
FIG. 5*b* is a view corresponding to FIG. 5*a* with the linkage in the raised position.
Figure 5A:
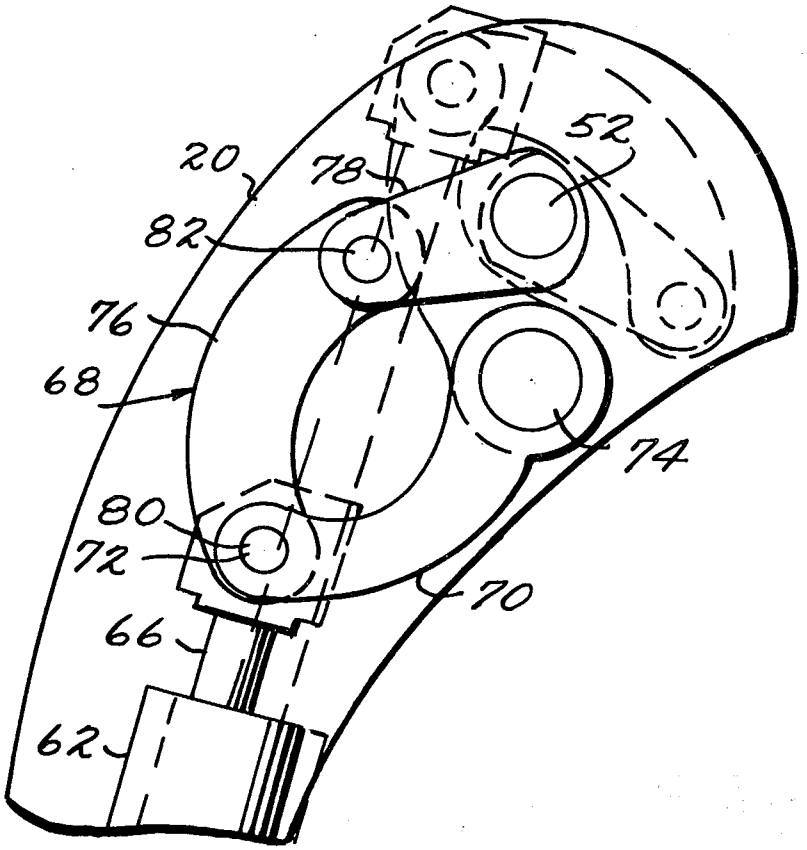
FIG. 5*a* is a fragmentary view illustrating the linkage between the power source and the raising and lowering mechanism when in the lowered position.

As shown in FIGS. 5*a* and 5*b* the linkage 68 includes two parts. The first part comprises two parallel identical arcuate links 70 each pivotally connected at 72 at one end to the piston rod 66 and at its other end to a fixed shaft 74 which is rigidly connected at its ends to the channel members 20. The second part of the linkage 68 includes a pair of identical two-link assemblies each having an arcuate link 76 and a shorter straight link 78. Each of the arcuate links 76 is pivotally connected at one end at 80 to the piston rod 66 and pivotally connected at its other end at 82 to one end of the straight link 78. The remaining end of the straight link 78 is rigidly secured to the shaft 52. The axis of all of the pivotal connections 72, 74, 80 and 82 are parallel to the shaft 52. The piston and cylinder unit is operated by hydraulic circuitry which may be conventional and which is therefore not described here. Conveniently the control portion of the circuitry is located in the cab of the vehicle 10.

OPERATION

When the vehicle 10 has been positioned adjacent the container 18 the maast assembly, i.e. the two upright channel members 20 and their associated parts, is extended laterally so as to engage the container engaging assembly 30 with the container 18. As stated previously the engaging operation may be effected with any suitable mechanism, and in addition the actual lateral movement of the engaging device can be effected by pivotal movement of the lower end of the mast assembly rather than linear movement. In the illustrated embodiment the mast assembly is extended by the drive device 26, and engagement with the container is accomplished by insertion of the rollers 36 into the slots 38. Subsequent retraction of the mast assembly toward the vehicle is effected in order to bring the container 18 into a correct final dumping position. If the mast assembly is pivotally attached at its upper end to the vehicle, rather than being slidably attached at its lower end, then retracting movement is not necessary.

Elevation of the container gripping device 30 is initiated by pressurizing the piston and cylinder unit so as to extend the piston rod 66 from the cylinder 62. This upward movement of the piston rod 66 is transmitted by the linkage 68 as torque to the shaft 52 which starts to rotate clockwise as viewed in FIG. 4. As the upper arm 54 of the articulated arm assembly 50 is rigidly secured to the shaft 52, the clockwise rotation of the latter causes the arm 54 to begin to swing upwardly in a plane transverse to the vehicle axis. The lower arm 58 is thereby pulled upwardly, and begins to fold toward the upper arm 54, causing the container engaging device 30 and the attached container 18 to begin moving upwardly along the channel members 20. FIG. 4 illustrates four sequential positions A, B, C and D of the arms 54 and 58. Positions A and D are the limit positions. As the engaging device 30 moves along the channel members 20, guided by the rollers 44 in the runways 42, its speed gradually increases until it reaches the curved portions of the channel members 20. The speed of the engaging device 30 then gradually reduces until it begins to move past the axis of the shaft 52. A substantially constant speed is then attained and maintained until the drive system approaches maximum travel, at which time the engaging device 30 tips to effect dumping of the contents of the container 18 into the vehicle body 14. The dumping operation is completed when the drive system comes to a stop. These improvements result from the interaction of the linkage 68, the articulated arm assembly 50 and the guide slots 42 in the channel members 20.

FIGS. 5*a* and 5*b* illustrate in detail the operation of the linkage 68 between the piston rod 66 and the shaft 52 during movement of the piston rod 66. The solid line position in FIG. 5*a* is the position when the piston rod 66 is fully retracted. The phantom line position in FIG. 5*a* and the solid line position in FIG. 5*b* represent the position of the linkage 68 when the piston rod 66 is fully extended. During extension of the piston rod 66 the link 70 rotates clockwise about the fixed shaft 74 through an arc. The articulated linkage 76, 78 acts generally as a simple crank during the first portion of movement of the piston rod 66, thereby causing the shaft 52 (which is rigidly connected to the link 78) to rotate clockwise and causes the arms 54 and 58 to begin moving from position A toward positions B and C (FIG. 4), thereby moving the engaging device 30 upwardly along the straight portions of the channel members 20 at an increasing speed. That is, as the arms 54 swing upwardly, movement of the engaging device accelerates because the arms 54 are swinging with a maximum arc or radius. When the engaging device 30 begins to enter its more pronounced curved path near and at the upper ends of the channel members 20, the articulated linkage 76, 78 begins to fold about the pivot axis 82. As the arms 54 continue around the upper arc the length of the radius arm shortens. This in turn decelerates the engaging device 30 to a substantially constant lower speed, following which the engaging device 30 causes the container to tip toward the vehicle in a dumping operation. The piston rod 66 is then at its fully extended position.

Subsequent retraction of the piston rod 66 reverses the movements of the linkage 68, the arm assembly 50 and the engaging device 30 so as to return the empty container 18 to the ground.

What is claimed is:

1. In apparatus for attachment to a vehicle for raising and lowering a container relative to the vehicle and for tipping the container when in a raised position so as to dump the contents of the container into the body of the vehicle, said apparatus being of the kind having an upright mast assembly and container engaging means arranged on said mast assembly for guided vertical movement relative thereto, an improved mechanism for raising and lowering said container engaging means comprising: an articulated arm assembly having a lower end pivoted to said container engaging means for rotation about a first horizontal axis and an upper end mounted for swinging movement about a second horizontal axis; and means for swinging said arm assembly about said second axis, said axes being parallel and arranged such that the members of the arm assembly swing in a vertical plane which is transverse to the axis of the vehicle, upward swinging movement of said assembly raising said container engaging means upwardly along said mast assembly and tipping said container engaging means in a mode to dump the contents of a container engaged by said container engaging means at the upper end of said path and downward swinging movement of said assembly tipping said container engaging means in an opposite mode and moving said container engaging means downwardly along said mast assembly.

2. Apparatus as in claim 1 wherein said means for swinging said upper end of said arm assembly includes a shaft coaxial with said second horizontal axis and rigidly connected to said upper end of said arm assembly and means for rotating said shaft about said second horizontal axis.

3. Apparatus as in claim 2 wherein said means for rotating said shaft includes a hydraulic ram interconnected between said shaft and said mast assembly.

4. Apparatus as in claim 2 wherein said articulated arm assembly effects a reduced speed of said container gripping means as the latter beings to tip in a dumping mode.

5. Apparatus as in claim 4 wherein said articulated arm assembly has an upper arm and a lower arm of generally the same length, said arms being arranged in end-to-end relationship and pivoted to each other for folding about an axis parallel to said first and second axes.

6. In apparatus for attachment to a vehicle for raising and lowering a container relative to the vehicle and for tipping the container when in a raised position so as to dump the contents of the container into the body of the vehicle, said apparatus being of the kind having an upright mast assembly and container engaging means arranged on said mast assembly for guided vertical movement relative thereto, an improved mechanism for raising and lowering said container engaging means comprising: an articulated foldable arm assembly having a lower end pivoted to said container engaging means for rotation about a first horizontal axis and an upper end rigidly connected to a rotatable shaft having a second horizontal axis parallel to said first axis such that upon rotation of said shaft, said arms are foldable and unfoldable with respect to each other by swinging movement in a vertical plane which is transverse to said first and second axes; and means for rotating said shaft, said means including a hydraulic piston and cylinder unit pivotally connected at one end to said mast assembly and at its other end to one end of an articulated linkage which is rigidly connected at its other end to said shaft, said linkage being foldable during the latter portion of a raising operation to effect, in conjunction with folding of the arms of said arm assembly, a reduced speed of said container engaging means.

7. In apparatus for attachment to a vehicle for raising and lowering a container relative to the vehicle and for tipping the container when in a raised position so as to dump the contents of the container into the body of the vehicle, said apparatus being of the kind having an upright mast assembly and container engaging means arranged on said mast assembly for guided vertical movement relative thereto, an improved mechanism for raising and lowering said container engaging means comprising: an articulated arm assembly including a lowermost arm pivoted to said container gripping means for rotation about a first horizontal axis and an uppermost arm connected to a horizontal shaft for rotation therewith; and means for rotating said shaft about its axis to thereby swing said arm assembly about said shaft axis, said axes being parallel and arranged such that the members of the arm assembly swing in a vertical plane which is transverse to the axis of the vehicle, upward swinging movement of said assembly raising said container gripping means upwardly along said mast assembly and tipping said container engaging means in a mode to dump the contents of a container engaged by said container engaging means at the upper end of said path and downward swinging movement of said assembly tipping said container engaging means in an opposite mode and moving said container engaging means downwardly along said mast assembly.

* * * * *